US011337022B2

(12) United States Patent
Honma et al.

(10) Patent No.: US 11,337,022 B2
(45) Date of Patent: May 17, 2022

(54) INFORMATION PROCESSING APPARATUS, METHOD, AND PROGRAM

(71) Applicant: Sony Corporation, Tokyo (JP)

(72) Inventors: Hiroyuki Honma, Chiba (JP); Toru Chinen, Kanagawa (JP); Yoshiaki Oikawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 17/045,154

(22) PCT Filed: Mar. 26, 2019

(86) PCT No.: PCT/JP2019/012723
§ 371 (c)(1),
(2) Date: Oct. 2, 2020

(87) PCT Pub. No.: WO2019/198486
PCT Pub. Date: Oct. 17, 2019

(65) Prior Publication Data

US 2021/0152968 A1 May 20, 2021

(30) Foreign Application Priority Data

Apr. 9, 2018 (JP) ..... JP2018-074616

(51) Int. Cl.
*H04S 7/00* (2006.01)
*G10L 19/008* (2013.01)
*H04S 3/00* (2006.01)

(52) U.S. Cl.
CPC ..... *H04S 7/303* (2013.01); *G10L 19/008* (2013.01); *H04S 3/008* (2013.01); *H04S 2400/01* (2013.01);
(Continued)

(58) Field of Classification Search
None
See application file for complete search history.

(56) References Cited

U.S. PATENT DOCUMENTS 10,645,522 B1 * 5/2020 Mindlin ..... H04S 7/307
2005/0058297 A1 3/2005 Jot
(Continued)

FOREIGN PATENT DOCUMENTS

CN 102209288 A 10/2011
CN 103220595 A 7/2013
(Continued)

OTHER PUBLICATIONS

International Search Report and English translation thereof dated Jun. 18, 2019 in connection with International Application No. PCT/JP2019/012723.
(Continued)

*Primary Examiner* — Qin Zhu
(74) *Attorney, Agent, or Firm* — Wolf, Greenfield & Sacks, P.C.

(57) ABSTRACT

The present technology relates to an information processing apparatus, a method, and a program that can create a great sense of realism with a small number of computations.
An information processing apparatus includes a gain determination section that determines an attenuation level on the basis of a positional relationship between a given object and another object and determines a gain of a signal of the given object on the basis of the attenuation level. The present technology is applicable to a signal processing apparatus.

15 Claims, 11 Drawing Sheets

(52) U.S. Cl.
CPC ..... *H04S 2400/11* (2013.01); *H04S 2400/13* (2013.01)

(56) References Cited

U.S. PATENT DOCUMENTS

| | | | | |
|---|---|---|---|---|
| 2008/0240448 | A1* | 10/2008 | Gustafsson | H04S 7/30 381/17 |
| 2009/0137314 | A1 | 5/2009 | Nakayama | |
| 2013/0120569 | A1 | 5/2013 | Mizuta | |
| 2021/0084429 | A1* | 3/2021 | Tajik | G06T 19/006 |
| 2021/0127224 | A1* | 4/2021 | Laaksonen | G10L 19/008 |
| 2021/0168508 | A1* | 6/2021 | Walther | H04R 3/12 |
| 2021/0195358 | A1* | 6/2021 | Cricri | H04S 7/301 |

FOREIGN PATENT DOCUMENTS

| | | | |
|---|---|---|---|
| CN | 106686520 | A | 5/2017 |
| EP | 1994969 | A1 | 11/2008 |
| EP | 2591832 | A2 | 5/2013 |
| JP | 2007-236833 | A | 9/2007 |
| JP | 2013-102842 | A | 5/2013 |
| JP | 2014-090293 | A | 5/2014 |
| JP | 2017-192103 | A | 10/2017 |
| WO | WO-2008040805 | A1 | 4/2008 |

OTHER PUBLICATIONS

[No Author Listed], AC-4 Object Audio Renderer for Consumer Use. ETSI TS 103 448 V1.1.1. Technical Specification. EBU Operating Eurovision. Sep. 2016. 39 pages.

[No Author Listed], International Standard ISO/IEC 23008-3. Information technology—High efficiency coding and media delivery in heterogeneous environments—Part 3: 3D audio. Feb. 1, 2016. 439 pages.

Reiter Ulrich et al: "Determination of Sound Source Obstruction in Virtual Scenes", AES Convention, [Online] Jun. 1, 2003 (Jun. 1, 2003), pp. 1-6, XP055793615, Retrieved from the Internet: URL:http://www.aes.org/elib/inst/download.cfm/12303.pdf?ID=12303[retrieved on Apr. 7, 2021].

* cited by examiner

INFORMATION PROCESSING APPARATUS, METHOD, AND PROGRAM

CROSS-REFERENCE TO RELATED APPLICATIONS

This is a U.S. National Stage Application under 35 U.S.C. § 371, based on International Application No. PCT/JP2019/012723, filed in the Japanese Patent Office as a Receiving Office on Mar. 26, 2019, entitled "INFORMATION PROCESSING DEVICE AND METHOD, AND PROGRAM," which claims priority under 35 U.S.C. § 119(a)-(d) or 35 U.S.C. § 365(b) to Japanese Patent Application Number JP2018-074616, filed in the Japanese Patent Office on Apr. 9, 2018, each of which is hereby incorporated by reference in its entirety.

TECHNICAL FIELD

The present technology relates to an information processing apparatus, a method, and a program, and in particular, to an information processing apparatus, a method, and a program that can create a great sense of realism with a small number of computations.

BACKGROUND ART

As of now, an object audio technology has been applied to movies, games, and so on, and coding schemes that allow handling of object audio have been developed. Specifically, for example, MPEG (Moving Picture Experts Group)-H Part 3:3D audio standard as an international standard is known (refer, for example, to NPL 1).

Such a coding scheme treats moving sound sources and so on as independent audio objects with a conventional two-channel stereo scheme or a multi-channel stereo scheme such as 5.1 channels, allowing for coding of object position information as metadata together with audio object signal data.

This allows for reproduction in a variety of viewing environments with a different number and different layouts of speakers. Also, it is easy to tailor a sound of a specific sound source that is difficult for a conventional coding scheme to tailor during reproduction, for example, by adjusting a sound volume and adding effects to the sound of the specific sound source.

For example, the standard described in NPL 1 employs a scheme called three-dimensional VBAP (Vector Based Amplitude Panning) (hereinafter simply referred to as VBAP) for a rendering process.

This is a rendering technique commonly called panning that carries out rendering by distributing gains, of speakers existing on a spherical surface having a user position as its origin, to three speakers closest to audio objects similarly existing on the spherical surface.

In addition to VBAP, for example, there is known a rendering process that is carried out by a panning technique called Speaker-anchored coordinates panner that distributes gains to x, y, and z axes, respectively (for example, see NPL 2).

CITATION LIST

Non Patent Literature

[NPL 1]
INTERNATIONAL STANDARD ISO/IEC 23008-3 First edition 2015-10-15 Information technology—High efficiency coding and media delivery in heterogeneous environments—Part 3: 3D audio
[NPL 2]
ETSI TS 103 448 v1.1.1(2016-09)

SUMMARY

Technical Problems

Incidentally, the above rendering scheme renders object signals of a plurality of audio objects for each audio object without taking account of changes in acoustics attributable to a relative positional relationship between audio objects. Therefore, a great sense of realism could not be obtained during sound reproduction.

It is assumed, for example, that a sound is produced from a second audio object behind a certain first audio object as seen from a viewer's position. In such a case, attenuation effects that occur as a result of reflection, diffraction, and absorption of a sound produced by the first audio object are completely ignored for the sound of the second audio object.

It should be noted that the user position is fixed in the above rendering scheme. Therefore, it is possible to adjust object signal levels in advance, for example, on the basis of the relationship between the user position and the positions of the plurality of audio objects.

Such a level adjustment allows for representation of acoustic changes attributable to the relative positional relationship between the audio objects. For example, therefore, a great sense of realism can be created by calculating attenuation effects produced by sound reflection, diffraction, and absorption in audio objects on the basis of physics laws and adjusting the levels of the object signals of the audio objects on the basis of the calculation results, in advance.

However, in the case where there are many audio objects, calculation of attenuation effects produced by such sound reflection, diffraction, and absorption on the basis of physics laws involves a large number of computations, making such an option unrealistic.

Moreover, although a fixed viewpoint with a fixed user position allows for generation of an object signal that takes sound reflection, diffraction, and other factors into consideration by adjusting the level in advance, such a prior level adjustment is completely meaningless in a free viewpoint with a movable user position.

The present technology has been devised in light of the foregoing, and it is an object of the present technology to create a great sense of realism with a small number of computations.

Solution to Problems

An information processing apparatus of an aspect of the present technology includes a gain determination section that determines an attenuation level on the basis of a positional relationship between a given object and another object and determines a gain of a signal of the given object on the basis of the attenuation level.

An information processing method or a program of an aspect of the present technology includes a step of determining an attenuation level on the basis of a positional relationship between a given object and another object and determining a gain of a signal of the given object on the basis of the attenuation level.

In an aspect of the present technology, an attenuation level is determined on the basis of a positional relationship between a given object and another object, and a gain of a signal of the given object is determined on the basis of the attenuation level.

Advantageous Effect of Invention

According to the aspect of the present technology, a great sense of realism can be obtained with a small number of computations.

It should be noted that the effect described herein is not necessarily limited and may be any one of the effects described in the present disclosure.

DESCRIPTION OF EMBODIMENTS

A description will be given below of embodiments to which the present technology is applied with reference to drawings.

<First Embodiment>

<Present Technology>

The present technology creates a sufficiently great sense of realism with a small number of computations in the case of audio object rendering by determining audio object gain information on the basis of a positional relationship between a plurality of audio objects in a space.

It should be noted that the present technology is applicable not only to rendering of audio objects but also to the case where, for a plurality of objects existing in a space, parameters related to the objects are adjusted according to the positional relationship between the objects. The present technology is also applicable, for example, to the case where the amount of adjustment for parameters such as luminance (amount of light) related to an object image signal is determined according to the positional relationship between the objects.

The description will continue below by taking, as a specific example, the case of rendering audio objects. Incidentally, audio objects will be also simply referred to as objects below.

For example, a given type of rendering process such as VBAP described above is performed. VBAP distributes, of speakers existing on a spherical surface having a user position as its origin in a space, gains to three speakers closest to audio objects similarly existing on the spherical surface.

Figure 1:
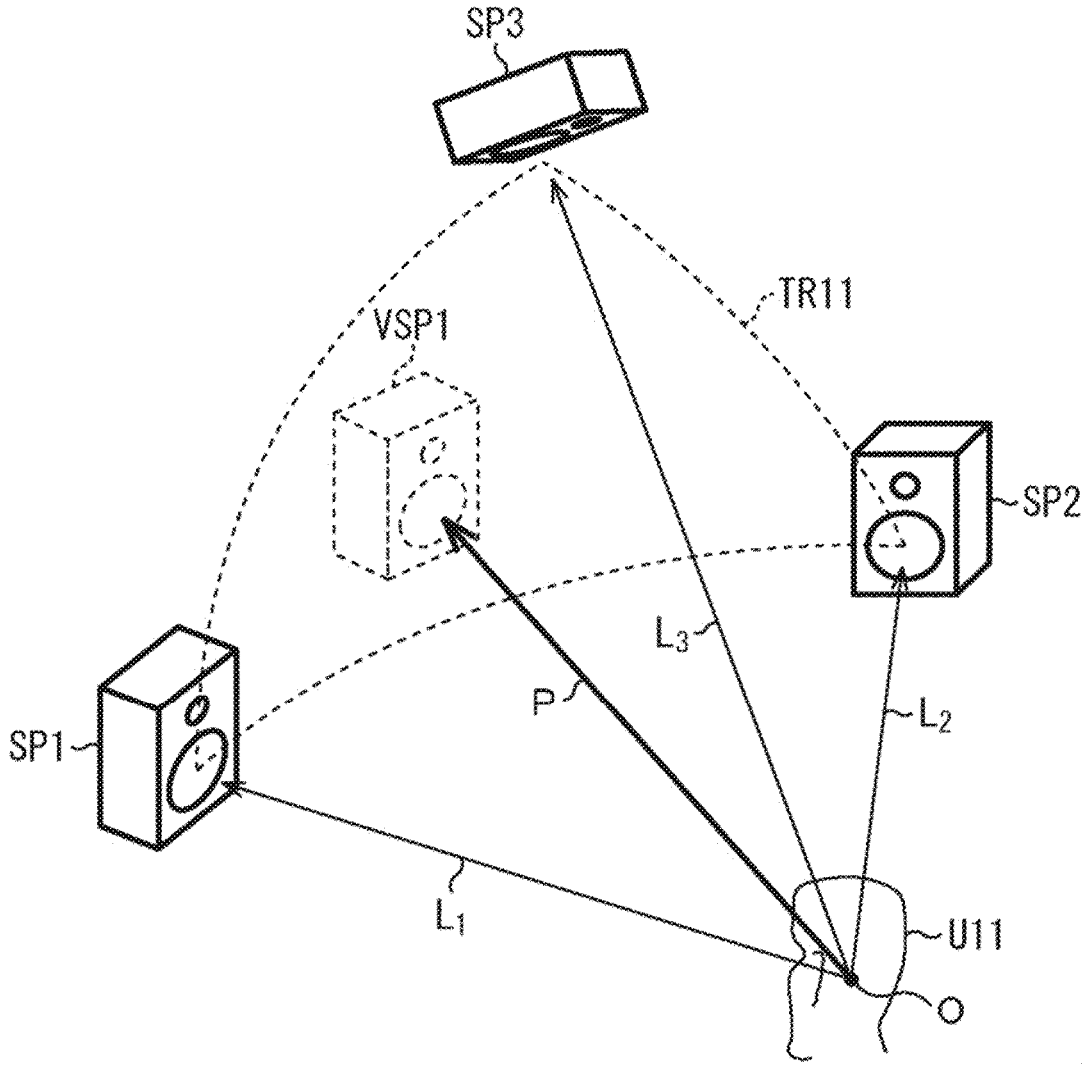
FIG. 1 is a diagram describing VBAP.

For example, a user U11 as a listener is present in a three-dimensional space, and three speakers SP1 to SP3 are provided in front of the user U11, as illustrated in FIG. 1.

Also, it is assumed that a head position of the user U11 is an origin O and that the speakers SP1 to SP3 are located on the surface of a sphere having its center at the origin O.

It is assumed that an object is present inside a region TR11 surrounded by the speakers SP1 to SP3 on the spherical surface and that a sound image is localized at a position VSP1 of the object.

In such a case, VBAP distributes gains to the speakers SP1 to SP3 around the position VSP1 for the object.

Specifically, it is assumed that, in the three-dimensional coordinate system having its reference (origin) at the origin O, the position VSP1 is represented by a three-dimensional vector P having its start point at the origin O and its end point at the position VSP1.

Also, letting three-dimensional vectors having their start points at the origin O and their end points at the respective positions of the speakers SP1 to SP3 be denoted as vectors $L_1$ to $L_3$, the vector P can be expressed by a linear sum of the vectors $L_1$ to $L_3$ as illustrated by the following formula (1).

[Math. 1]

$$P=g_1L_1+g_2L_2+g_3L_3 \tag{1}$$

Here, the sound image can be localized at the position VSP1 by calculating coefficients $g_1$ to $g_3$ by which the vectors $L_1$ to $L_3$ are multiplied in formula (1) and treating the coefficients $g_1$ to $g_3$ as gains of the sounds output from the respective speakers SP1 to SP3.

For example, letting a vector having the coefficients $g_1$ to $g_3$ as its elements be denoted as $g_{123}=[g_1, g_2, g_3]$ and a vector having the vectors $L_1$ to $L_3$ as its elements be denoted as $L_{123}=[L_1,L_2,L_3]$, the following formula (2) can be obtained by modifying the formula (1) described above.

[Math. 2]

$$g_{123}=P^TL_{123}^{-1} \tag{2}$$

The sound image can be localized at the position VSP1 by using the coefficients $g_1$ to $g_3$ calculated by using formula (2) as gains and outputting object signals, that is, signals of the sound of the object, to the respective speakers SP1 to SP3.

It should be noted that the respective speakers SP1 to SP3 are provided at fixed positions and that information representing the speaker positions is known. Therefore, $L_{123}^{-1}$ as an inverse matrix can be obtained in advance. For such a reason, VBAP can carry out rendering with relatively easy calculations, that is, with a small number of computations.

However, in the case where a plurality of objects exists in a space during rendering by VBAP or the like as described above, changes in acoustics attributable to a relative positional relationship between the objects are not taken into account at all. Therefore, a great sense of realism could not be obtained during sound reproduction.

Also, although adjusting an object signal level in advance is a possible option, calculation of attenuation effects for such a level adjustment on the basis of physics laws involves a large number of computations, making such an option unrealistic. Further, the user position changes in a free viewpoint. As a result, such a prior level adjustment is completely meaningless.

For such a reason, the present technology adjusts the object signal level on the sound generation side by using information regarding object attenuation, thus creating a great sense of realism with a small number of computations.

In particular, the present technology determines gain information for adjusting the object signal level on the basis of a relative positional relationship between audio objects, thus delivering attenuation effects produced by reflection, diffraction, and absorption of a sound, i.e., changes in acoustics, even with a small number of computations. This makes it possible to create a great sense of realism.

<Configuration Example of the Signal Processing Apparatus>

A description will be given next of a configuration example of a signal processing apparatus to which the present technology is applied.

Figure 2:
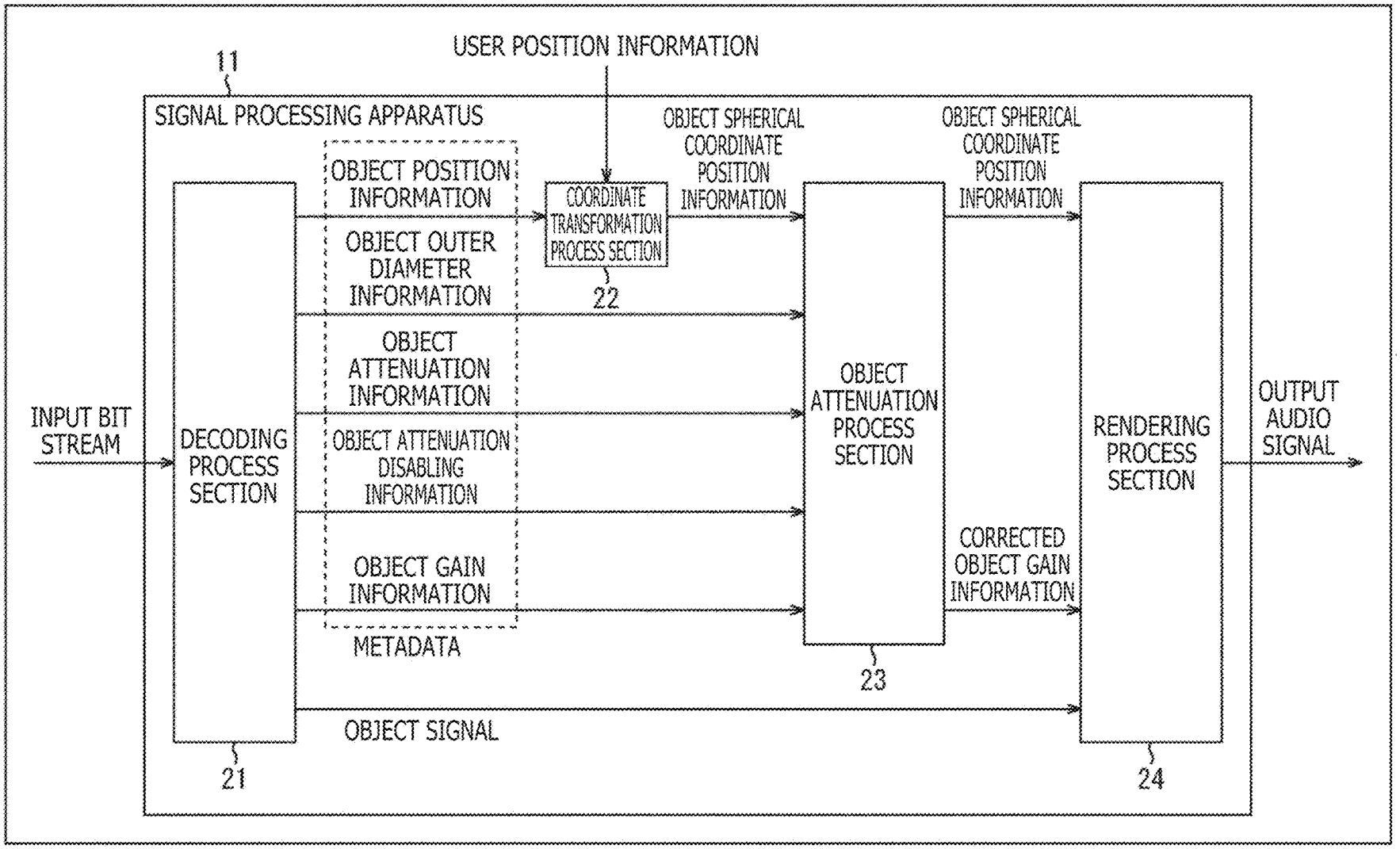
FIG. 2 is a diagram illustrating a configuration example of a signal processing apparatus.

FIG. 2 is a diagram illustrating the configuration example of an embodiment of the signal processing apparatus to which the present technology is applied.

A signal processing apparatus 11 illustrated in FIG. 2 includes a decoding process section 21, a coordinate transformation process section 22, an object attenuation process section 23, and a rendering process section 24.

The decoding process section 21 receives a transmitted input bit stream, decodes the stream, and outputs metadata regarding an object and an object signal that are obtained as a result of decoding.

Here, the object signal is an audio signal for reproducing a sound of the object. Also, the metadata includes, for each object, object position information, object outer diameter information, object attenuation information, object attenuation disabling information, and object gain information.

The object position information is information indicating an absolute position of an object in a space where the object is present (hereinafter also referred to as a listening space).

For example, the object position information is coordinate information indicating an object position represented by coordinates of a three-dimensional Cartesian coordinate system having a given position as its origin, that is, x, y, and z coordinates of an xyz coordinate system.

The object outer diameter information is information indicating the outer diameter of an object. For example, it is assumed here that the object is spherical and that the radius of the sphere is the object outer diameter information representing the outer diameter of the object.

It should be noted that, although the description will be given below assuming that the object is spherical, the object may be in any shape. For example, the object may be in the shape having a diameter in each of directions along the x, y, and z axes, and information indicating the radius of the object in each direction along a corresponding axis may be used as the object outer diameter information.

Also, outer diameter information for spread may be used as the object outer diameter information. For example, a technology called spread is employed as a technology for expanding the size of a sound source in the MPEG-H Part 3:3D audio standard, providing a format that permits recording of outer diameter information of each object so as to expand the sound source size. For such a reason, such outer diameter information for spread may be used as the object outer diameter information.

The object attenuation information is information regarding a sound attenuation level when, because of an object, a sound from another object is attenuated. The use of the object attenuation information provides an attenuation level of an object signal of another object at a given object according to a positional relationship between objects.

The object attenuation disabling information is information indicating whether or not to perform an attenuation process on a sound of an object, i.e., an object signal, that is, whether or not to attenuate the object signal.

For example, in the case where a value of the object attenuation disabling information is 1, the attenuation process on the object signal is disabled. That is, in the case where the value of the object attenuation disabling information is 1, the object signal is not subject to the attenuation process.

In the case where the intention of a sound source creator is, for example, that a certain object is essential and that any attenuation effects are not desired on sounds of the object due to a positional relationship with another object, the value of the object attenuation disabling information is set to 1. It should be noted that an object whose value of the object attenuation disabling information is 1 will be also referred to below as an attenuation-disabled object.

In contrast, in the case where the value of the object attenuation disabling information is 0, the object signal is subject to the attenuation process according to the positional relationship between the object and the other object. An object whose value of the object attenuation disabling information is 0 and that may be, therefore, subject to the attenuation process will be also referred to below as an attenuation process object.

The object gain information is information indicating a gain determined in advance on the side of the sound source creator for adjusting the object signal level. A decibel value representing a gain is an example of the object gain information.

When the object signal and the metadata for each object are acquired by the decoding performed by the decoding process section 21, the decoding process section 21 supplies the acquired object signals to the rendering process section 24.

Also, the decoding process section 21 supplies the object position information included in the metadata acquired by the decoding to the coordinate transformation process section 22. Further, the decoding process section 21 supplies, to the object attenuation process section 23, the object outer diameter information, the object attenuation information, the object attenuation disabling information, and the object gain information included in the metadata acquired by the decoding.

The coordinate transformation process section 22 generates object spherical coordinate position information on the basis of the object position information supplied from the decoding process section 21 and user position information supplied from external equipment, supplying the object spherical coordinate position information to the object attenuation process section 23. In other words, the coordinate transformation process section 22 transforms the object position information into the object spherical coordinate position information.

Here, the user position information is information indicating an absolute position of the user as a listener in the listening space where the object exists, that is, an absolute position of a user-desired listening point, and is used as coordinate information represented by the x, y, and z coordinates of the xyz coordinate system.

The user position information is not information included in the input bit stream but information supplied from, for example, an external user interface connected to the signal processing apparatus 11 or from other sources.

Also, the object spherical coordinate position information is information indicating a relative position of the object as seen from the user in the listening space and represented by coordinates of a spherical coordinate system, i.e., spherical coordinates.

The object attenuation process section 23 obtains corrected object gain information acquired by correcting the object gain information as appropriate on the basis of the object spherical coordinate position information that is supplied from the coordinate transformation process section 22 and the object outer diameter information, the object attenuation information, the object attenuation disabling information, and the object gain information that are supplied from the decoding process section 21.

In other words, the object attenuation process section 23 functions as a gain determination section that determines the corrected object gain information on the basis of the object spherical coordinate position information, the object outer diameter information, the object attenuation information, the object attenuation disabling information, and the object gain information.

Here, the gain value indicated by the corrected object gain information is acquired by correcting, as appropriate, the gain value indicated by the object gain information in consideration of the positional relationship between the objects.

Such corrected object gain information is used to realize the adjustment of object signal levels that take account of attenuation caused by sound reflection, diffraction, and absorption taking place in the objects due to the positional relationship between the objects, that is, changes in acoustics.

The rendering process section 24 adjusts, as an attenuation process, an object signal level on the basis of the corrected object gain information during rendering. Such an attenuation process can be said to be a process of attenuating the object signal level according to sound reflection, diffraction, and absorption.

The object attenuation process section 23 supplies the object spherical coordinate position information and the corrected object gain information to the rendering process section 24.

In the signal processing apparatus 11, the coordinate transformation process section 22 and the object attenuation process section 23 function as information processing apparatuses that determine, for each object, the corrected object gain information for adjusting the object signal level according to the positional relationship with another object.

The rendering process section 24 generates an output audio signal on the basis of the object signals supplied from the decoding process section 21 and the object spherical coordinate position information and the corrected object gain information supplied from the object attenuation process section 23, supplying the output audio signal to speakers, headphones, recording sections, and so on at the subsequent stages.

Specifically, the rendering process section 24 performs a panning process such as VBAP, as a rendering process, thus generating the output audio signal.

For example, in the case where VBAP is performed as a panning process, a calculation similar to that of formula (2) described above is made on the basis of the object spherical coordinate position information and layout information of each speaker, thus allowing gain information to be obtained for each speaker. Then, the rendering process section 24 adjusts the level of an object signal of a channel corresponding to each speaker on the basis of the obtained gain information and the corrected object gain information, thus generating an output audio signal that includes the signals of the plurality of channels. In the case of presence of a plurality of objects, a final output audio signal is generated by adding the signals of the same channel for each of the objects.

It should be noted that the rendering process performed by the rendering process section 24 may be any kind of process such as VBAP adopted in the MPEG-H Part 3:3D audio standard and a process based on a panning technique called Speaker-anchored coordinates panner.

Also, while the rendering process based on VBAP employs the object spherical coordinate position information, that is, position information of the spherical coordinate system, rendering is performed directly in the rendering process based on Speaker-anchored coordinates panner by using position information of the Cartesian coordinate system. In the case of rendering using the Cartesian coordinate system, therefore, the coordinate transformation process section 22 is only required to obtain the position information of the Cartesian coordinate system indicating the position of each object as seen from the user's position through coordinate transformation.

<Coordinate Transformation and Determination of Corrected Object Gain Information>

Next, a more detailed description will be given of coordinate transformation performed by the coordinate transformation process section 22 and processes performed by the object attenuation process section 23.

The coordinate transformation process section 22 receives the object position information and the user position information as inputs, performing coordinate transformation and outputting the object spherical coordinate position information.

Figure 3:
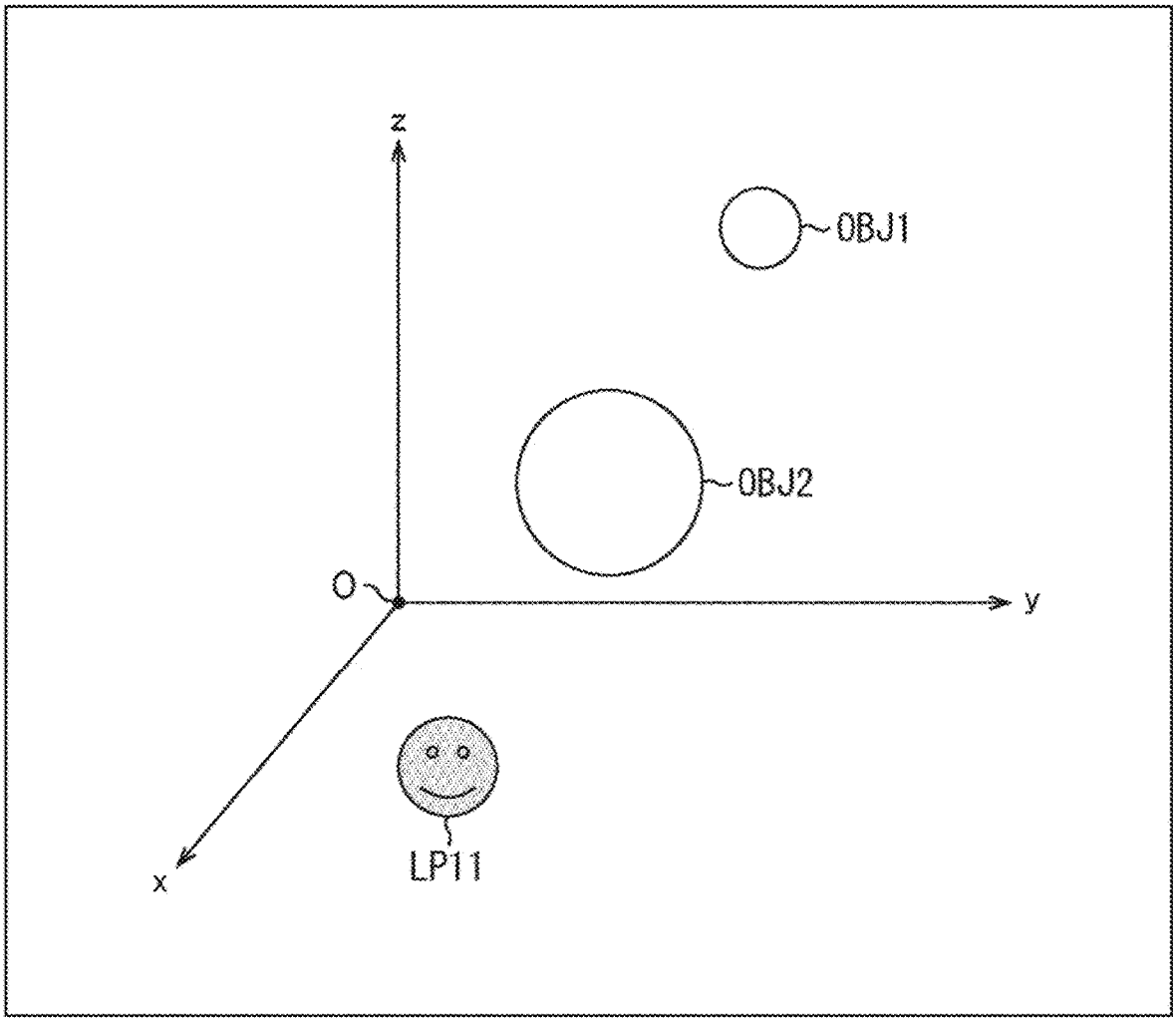
FIG. 3 is a diagram describing coordinate transformation.

Here, the object position information and the user position information used as inputs for coordinate transformation are represented, for example, as coordinates of the three-dimensional Cartesian coordinate system using the x, y, and z axes, that is, coordinates of the xyz coordinate system, as illustrated in FIG. 3.

In FIG. 3, the coordinates representing the position of a user LP11 as seen from the origin O of the xyz coordinate system are used as the user position information. Also, the coordinates representing the position of an object OBJ1 as seen from the origin O of the xyz coordinate system are used as the object position information of the object OBJ1, and the coordinates representing the position of an object OBJ2 as seen from the origin O of the xyz coordinate system are used as the object position information of the object OBJ2.

Figure 4:
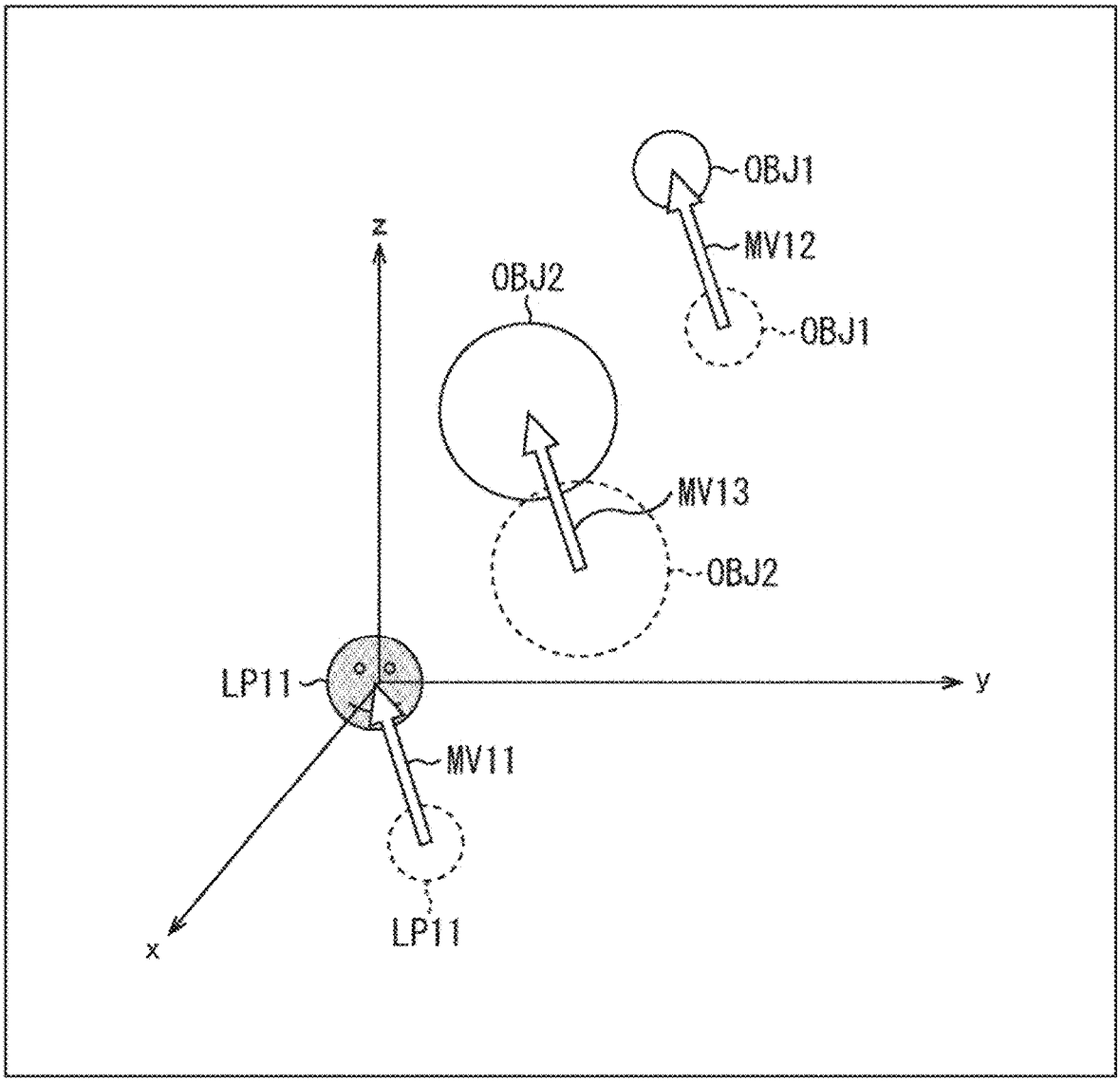
FIG. 4 is a diagram describing coordinate transformation

During coordinate transformation, the coordinate transformation process section 22 moves all objects in parallel in the listening space such that the position of the user LP11 is located at the origin O, for example, as illustrated in FIG. 4, and then transforms the coordinates of all objects in the xyz coordinate system into those in the spherical coordinate system. It should be noted that, in FIG. 4, the parts corresponding to those in FIG. 3 are denoted by the same reference signs, and a description thereof will be omitted as appropriate.

Specifically, the coordinate transformation process section 22 obtains a motion vector MV11 that causes the position of the user LP11 to move to the origin O of the xyz coordinate system on the basis of the user position information. The motion vector MV11 has its start point at the position of the user LP11 indicated by the user position information and its end point at the position of the origin O.

Also, the coordinate transformation process section 22 denotes a vector having the same magnitude (length) and running in the same direction as the motion vector MV11 and whose start point is at the position of the object OBJ1 as a motion vector MV12. Then, the coordinate transformation process section 22 moves the position of the object OBJ1 by a distance indicated by the motion vector MV12 on the basis of the object position information of the object OBJ1.

Similarly, the coordinate transformation process section 22 denotes a vector having the same magnitude and running in the same direction as the motion vector MV11 and whose start point is at the position of the object OBJ2 as a motion vector MV13, moving the position of the object OBJ2 by a distance indicated by the motion vector MV13 on the basis of the object position information of the object OBJ2.

Further, the coordinate transformation process section 22 obtains the coordinates in the spherical coordinate system representing the post-movement position of the object OBJ1 as seen from the origin O, treating the obtained coordinates as the object spherical coordinate position information of the object OBJ1. Similarly, the coordinate transformation process section 22 obtains the coordinates in the spherical coordinate system representing the post-movement position of the object OBJ2 as seen from the origin O, treating the obtained coordinates as the object spherical coordinate position information of the object OBJ2.

Figure 5:
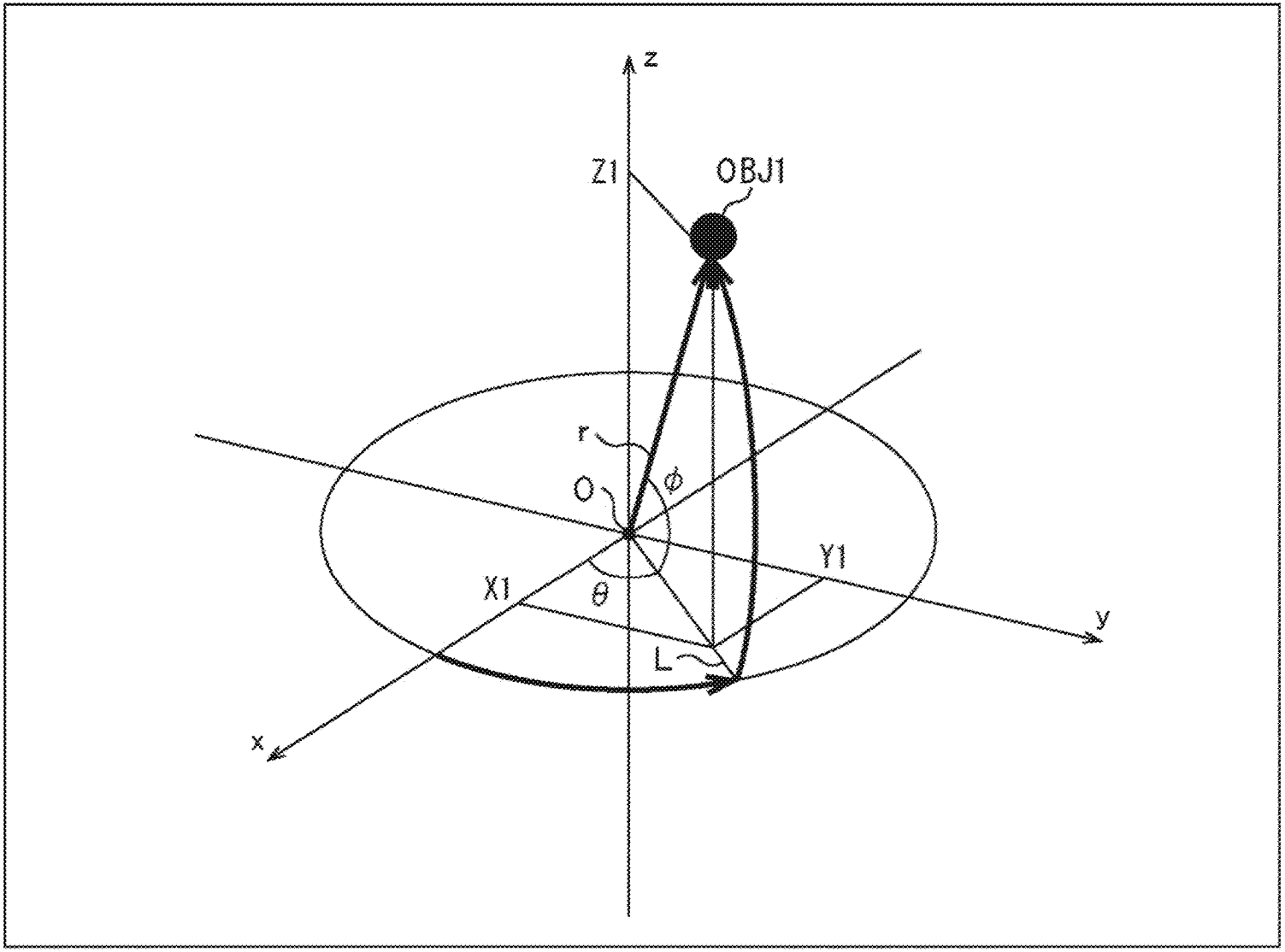
FIG. 5 is a diagram describing a coordinate system.

Here, the relationship between the spherical coordinate system and the xyz coordinate system is as illustrated in FIG. 5. It should be noted that, in FIG. 5, the parts corresponding to those in FIG. 4 are denoted by the same reference signs, and a description thereof will be omitted as appropriate.

In FIG. 5, the xyz coordinate system has the x, y, and z axes that pass through the origin O and are perpendicular to each other. In the xyz coordinate system, for example, the position of the object OBJ1 after the movement by the motion vector MV12 is represented as (X1, Y1, Z1) by using X1 as an x coordinate, Y1 as a y coordinate, and Z1 as a z coordinate.

In contrast, in the spherical coordinate system, the position of the object OBJ1 is represented by using an azimuth angle position_azimuth, an elevation angle position_elevation, and a radius position_radius.

Now it is assumed that a straight line connecting the origin O and the position of the object OBJ1 is denoted as a straight line r and a straight line obtained by projecting the straight line r onto an xy plane is denoted as a straight line L.

At this time, an angle θ formed between the x axis and the straight line L is the azimuth angle position_azimuth indicating the position of the object OBJ1. Also, an angle ϕ formed between the straight line r and the xy plane is the elevation angle position_elevation indicating the position of the object OBJ1, and the length of the straight line r is the radius position_radius indicating the position of the object OBJ1.

Therefore, the user position, i.e., spherical coordinate information including the azimuth angle, the elevation angle, and the radius of the object relative to the origin O, is the object spherical coordinate position information of the object. It should be noted that, in more detail, the object spherical coordinate position information is obtained by assuming, for example, that the positive direction of the x axis is the user's forward direction.

A description will be given next of the processes performed by the object attenuation process section 23.

It should be noted that, for simpler description, the description will be given here assuming that only the objects OBJ1 and OBJ2 are present in the listening space.

Figure 6:
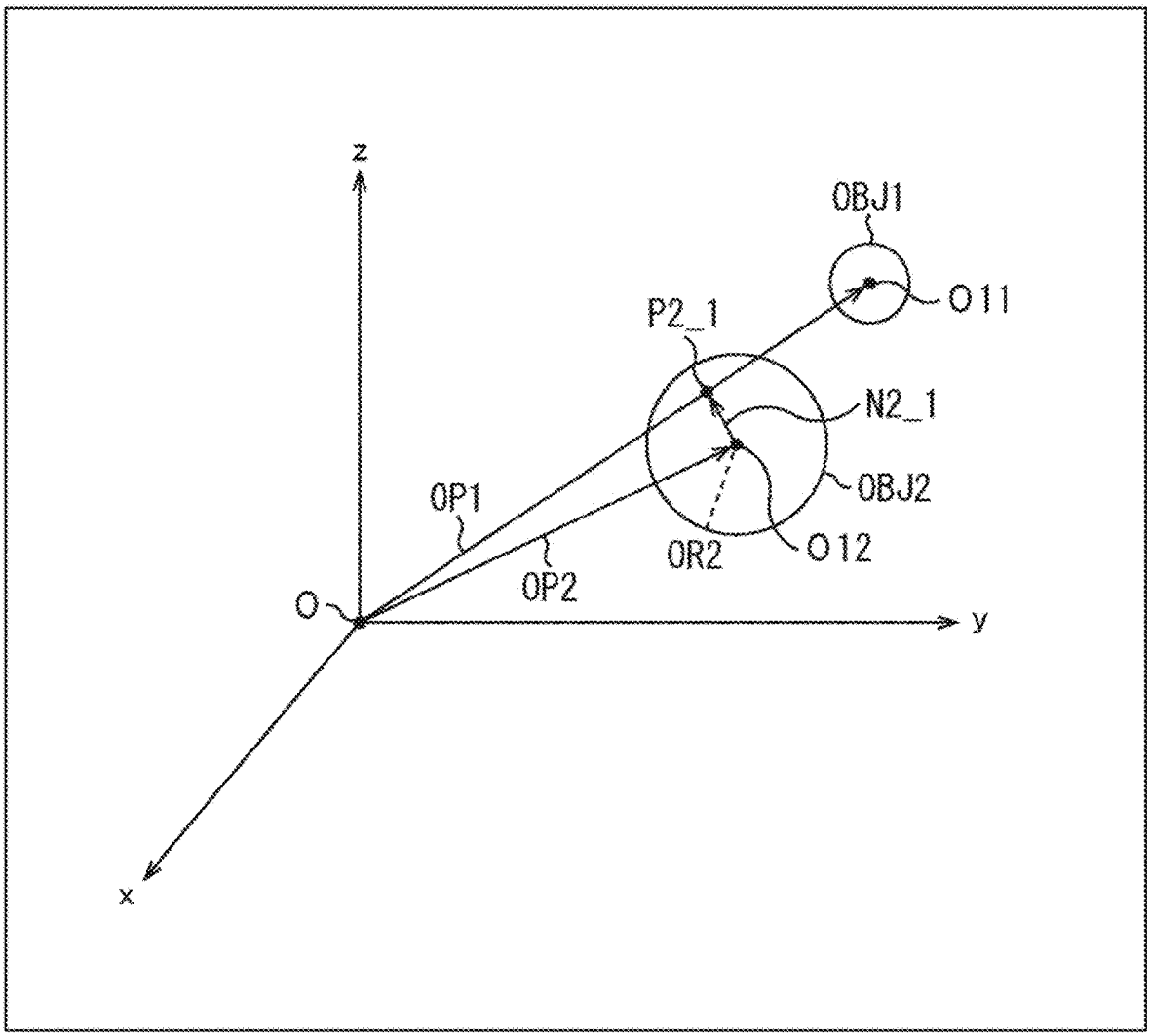
FIG. 6 is a diagram describing an attenuation distance and a radius ratio.

Specifically, for example, the corrected object gain information of the object OBJ1 is determined assuming, for example, that the objects OBJ1 and OBJ2 are present in the listening space as illustrated in FIG. 6. It should be noted that, in FIG. 6, the parts corresponding to those in FIG. 4 are denoted by the same reference signs, and a description thereof will be omitted as appropriate.

In the example illustrated in FIG. 6, it is assumed that the object OBJ1 is not an attenuation-disabled object but an attenuation process object whose value of the object attenuation disabling information is 0.

In order to determine the corrected object gain information of the object OBJ1, a vector OP1 indicating the position of the object OBJ1 is obtained first.

The vector OP1 is a vector having its start point at the origin O and its end point at a position O11 indicated by the object spherical coordinate position information of the object OBJ1. The user at the origin O listens to a sound emitted from the object OBJ1 at the position O11 toward the origin O. It should be noted that, in more detail, the position O11 indicates a center of the object OBJ1.

Next, an object at a shorter distance from the origin O than the object OBJ1, that is, an object located closer to the side of the origin O as the user position than the object OBJ1, is selected as an object subject to attenuation. The object subject to attenuation is an object that can cause attenuation of a sound produced from an attenuation process object because of its location between the attenuation process object and the origin O.

In the example illustrated in FIG. 6, the object OBJ2 is located at a position O12 indicated by the object spherical coordinate position information, and the position O12 is located closer to the side of the origin O than the position O11 of the object OBJ1. That is, the vector OP2 having its start point at the origin O and its end point at the position O12 is smaller in magnitude than the vector OP1.

In the example illustrated in FIG. 6, for such a reason, the object OBJ2 located closer to the side of the origin O than the object OBJ1 is selected as an object subject to attenuation. It should be noted that, in more detail, the position O12 indicates a center of the object OBJ2.

The object OBJ2 is in the shape of a sphere having its center at the position O12 with a radius OR2 indicated by the object outer diameter information, and the object OBJ2 is not a point sound source and has a given size.

Next, for the object OBJ2, which is the object subject to attenuation, a normal vector N2_1 from the object OBJ2, i.e., the position O12, to the vector OP1 can be obtained.

Letting the position of an intersection between the straight line that passes through the position O12 and is orthogonal to the vector OP1 and the vector OP1 be denoted as a position P2_1, the vector having its start point at the position O12 and its end position at the position P2_1 is the normal vector N2_1. In other words, the intersection between the vector OP1 and the normal vector N2_1 is the position P2_1.

Further, the normal vector N2_1 is compared with the radius OR2 indicated by the object outer diameter information of the object OBJ2, thus determining whether the magnitude of the normal vector N2_1 is equal to or smaller than the radius OR2 that is half the outer diameter of the object OBJ2, which is the object subject to attenuation.

The determination process is a process that determines whether or not the object OBJ2, which is the object subject to attenuation, is present in the path of a sound that is emitted from the object OBJ1 and travels toward the origin O.

In other words, the determination process can be said to be a process that determines whether or not the position O12 as the center of the object OBJ2 is located within a range of a given distance from a straight line connecting the origin O as the user position and the position O11 as the center of the object OBJ1.

It should be noted that the term "within a range of a given distance" here refers to a range determined by the size of the object OBJ2, and specifically, the term "given distance" refers to the distance from the position O12 to an end position of the object OBJ2 on the side of the straight line connecting the origin O and the position O11, that is, the radius OR2.

In the example illustrated in FIG. 6, for example, the magnitude of the normal vector N2_1 is equal to or smaller than the radius OR2. That is, the vector OP1 intersects the object OBJ2. Therefore, a sound emitted from the object OBJ1 toward the origin O attenuates as a result of reflection, diffraction, or absorption by the object OBJ2, traveling toward the origin O.

For such a reason, the object attenuation process section 23 determines the corrected object gain information for attenuating the object signal level of the object OBJ1 according to the relative positional relationship between the object OBJ1 and the object OBJ2. In other words, the object gain information is corrected for use as the corrected object gain information.

Specifically, the corrected object gain information is determined on the basis of an attenuation distance and a radius ratio that are pieces of information indicating the relative positional relationship between the object OBJ1 and the object OBJ2.

It should be noted that the attenuation distance refers to the distance between the object OBJ1 and the object OBJ2.

In such a case, letting the vector having its start point at the origin O and its end point at the position P2_1 be denoted as a vector OP2_1, the difference in magnitude between the vector OP1 and the vector OP2_1, that is, the distance from the position P2_1 to the position O11, is the attenuation distance of the object OBJ1 with respect to the object OBJ2. In other words, |OP1|-|OP2_1| is the attenuation distance.

Also, the radius ratio in such a case is the ratio of the distance from the position O12 as the center of the object OBJ2 to the straight line connecting the origin O and the position O11 to the distance from the position O12 to the end of the object OBJ2 on the side of the straight line.

Here, the object OBJ2 is spherical in shape. Therefore, the radius ratio of the object OBJ2 is the ratio of the magnitude of the normal vector N2_1 to the radius OR2, i.e., |N2_1|/OR2.

The radius ratio is information indicating an amount of deviation of the position O12 as the center of the object OBJ2 from the vector OP1, i.e., an amount of deviation of the position O12 from the straight line connecting the origin O and the position O11. Such a radius ratio can be said to be information indicating the positional relationship with the object OBJ1 dependent upon the size of the object OBJ2.

It should be noted that, although a description will be given here of an example in which a radius ratio is used as information indicating the positional relationship dependent upon the object size, information indicating the distance from the straight line connecting the origin O and the position O11 to the end position of the object OBJ2 on the side of the straight line or other information may be used.

The object attenuation process section 23 obtains a correction value for the object gain information of the object OBJ1, for example, on the basis of an attenuation table index and a correction table index as the object attenuation information included in metadata, and an attenuation distance and a radius ratio. Then, the object attenuation process section 23 corrects the object gain information of the object OBJ1 with the correction value, thus acquiring the corrected object gain information.

A description will be given here of an attenuation table indicated by the attenuation table index and a correction table indicated by the correction table index.

Figure 7:
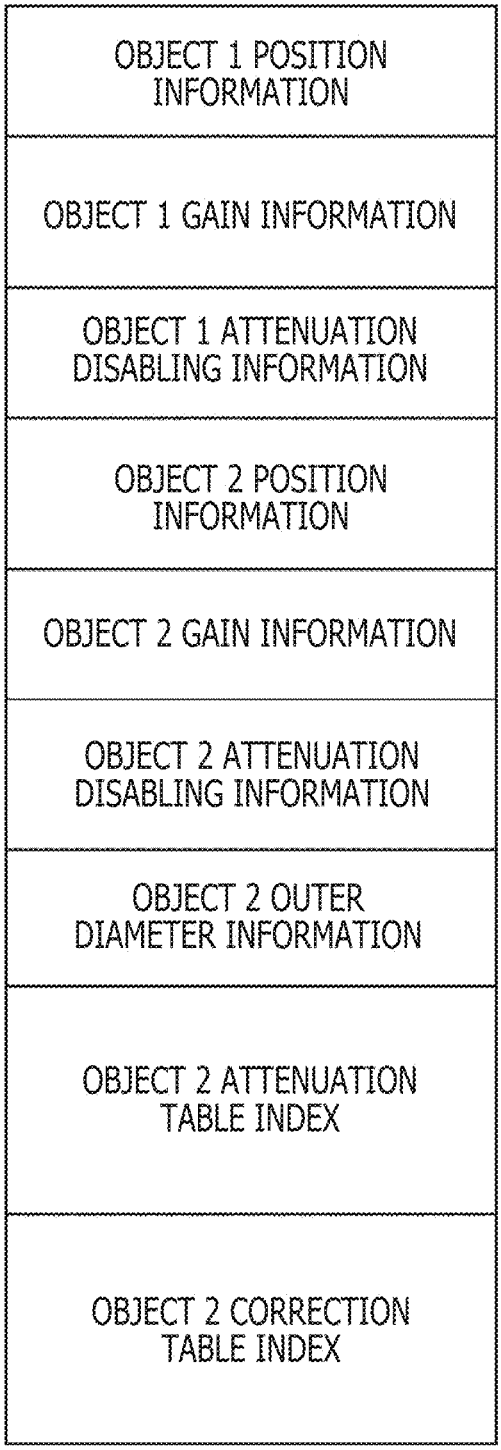
FIG. 7 is a diagram describing metadata.

For example, metadata of a given time frame included in an input bit stream is illustrated in FIG. 7.

In the example illustrated in FIG. 7, the characters "OBJECT 1 POSITION INFORMATION" indicate the object position information of the object OBJ1, the characters "OBJECT 1 GAIN INFORMATION" indicate the object gain information of the object OBJ1, and the characters "OBJECT 1 ATTENUATION DISABLING INFORMATION" indicate the object attenuation disabling information of the object OBJ1.

Also, the characters "OBJECT 2 POSITION INFORMATION" indicate the object position information of the object OBJ2, the characters "OBJECT 2 GAIN INFORMATION" indicate the object gain information of the object OBJ2, and the characters "OBJECT 2 ATTENUATION DISABLING INFORMATION" indicate the object attenuation disabling information of the object OBJ2.

Further, the characters "OBJECT 2 OUTER DIAMETER INFORMATION" indicate the object outer diameter information of the object OBJ2, the characters "OBJECT 2 ATTENUATION TABLE INDEX" indicate an attenuation table index of the object OBJ2, and the characters "OBJECT 2 CORRECTION TABLE INDEX" indicate a correction table index of the object OBJ2.

Here, the attenuation table index and the correction table index are pieces of the object attenuation information.

The attenuation table index is an index for identifying an attenuation table that indicates the attenuation level of the object signal appropriate to the attenuation distance described above.

The sound attenuation level caused by an object subject to attenuation varies depending on the distance between an attenuation process object and the object subject to attenuation. In order to obtain a suitable attenuation level appropriate to the attenuation distance easily with a small number of computations, an attenuation table that associates the attenuation distance with the attenuation level is used.

For example, a sound absorption rate and diffraction and reflection effects vary, for example, depending on an object material. Therefore, a plurality of attenuation tables is available in advance according to the object material and shape, a frequency band of the object signal, and so on. The attenuation table index is an index that indicates any of the plurality of attenuation tables, and a suitable attenuation table index is specified for each object by the side of the sound source creator according to the object material and so on.

Also, the correction table index is an index for identifying a correction table that indicates a correction rate of the attenuation level of the object signal appropriate to the radius ratio described above.

The radius ratio indicates how much a straight line representing the path of a sound emitted from an attenuation process object deviates from the center of an object subject to attenuation.

Even if the attenuation distance is the same, the actual attenuation level varies depending upon the amount of deviation of the object subject to attenuation from the path of the sound emitted from the attenuation process object, that is, the radius ratio.

For example, in general, in the case where a straight line connecting the origin O and the attenuation process object passes through an outer part of the object subject to attenuation far from the center thereof, the attenuation level is smaller due to a diffraction effect than in the case where the straight line passes through the center of the object subject to attenuation. For such a reason, a correction table associating the radius ratio with the correction rate is used to correct the attenuation level of the object signal according to the radius ratio.

The suitable correction rate appropriate to the radius ratio varies depending upon the object material and so on as in the case of the attenuation table. Therefore, a plurality of correction tables is available in advance according to the object material and shape, the frequency band of the object signal, and so on. The correction table index is an index that indicates any of the plurality of correction tables, and a suitable correction table index is specified for each object by the side of the sound source creator according to the object material and so on.

In the example illustrated in FIG. 7, the object OBJ1 is an object processed as a point sound source with no object outer diameter information. Therefore, only the object position information, the object gain information, and the object attenuation disabling information are given as metadata of the object OBJ1.

In contrast, the object OBJ2 is an object that has the object outer diameter information and attenuates a sound emitted from another object. For such a reason, the object outer diameter information and the object attenuation information are given as metadata of the object OBJ2 in addition to the object position information, the object gain information, and the object attenuation disabling information.

In particular, an attenuation table index and a correction table index are given here as the object attenuation information, and the attenuation table index and the correction table index are used to calculate a correction value of the object gain information.

Figure 8:
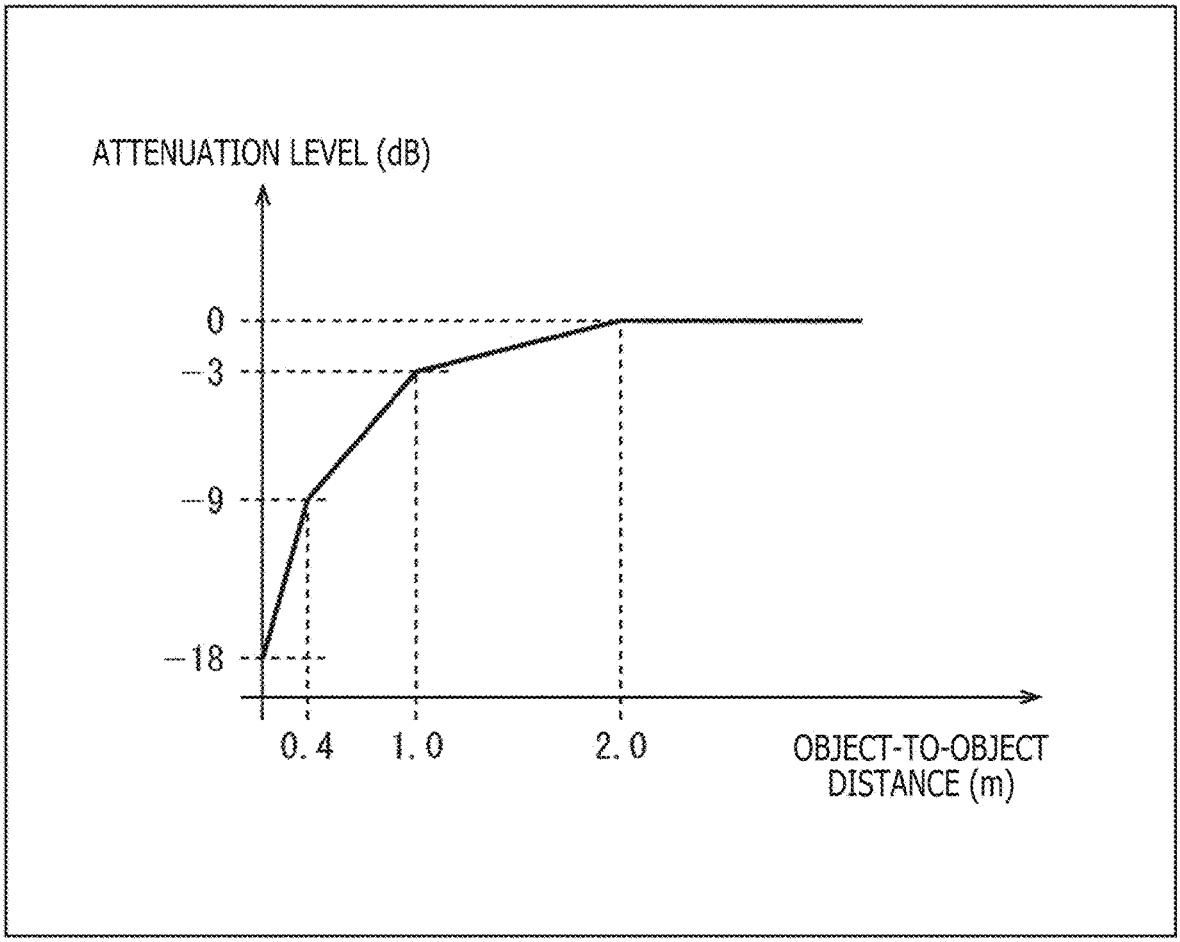
FIG. 8 is a diagram describing an attenuation table.

For example, an attenuation table indicated by a certain attenuation table index is information indicating the relationship between an attenuation distance and an attenuation level illustrated in FIG. 8.

In FIG. 8, the vertical axis represents the attenuation level in decibel value, and the horizontal axis represents the distance between the objects, i.e., the attenuation distance. In the example illustrated in FIG. 6, for example, the distance from the position P2_1 to the position O11 is the attenuation distance.

In the example illustrated in FIG. 8, the smaller the attenuation distance, the greater the attenuation level, and the smaller the attenuation distance, the greater the change in the attenuation level relative to the variation in the attenuation distance. From this, it is clear that the closer the object subject to attenuation to the attenuation process object, the greater the extent to which the sound of the attenuation process object attenuates.

Figure 9:
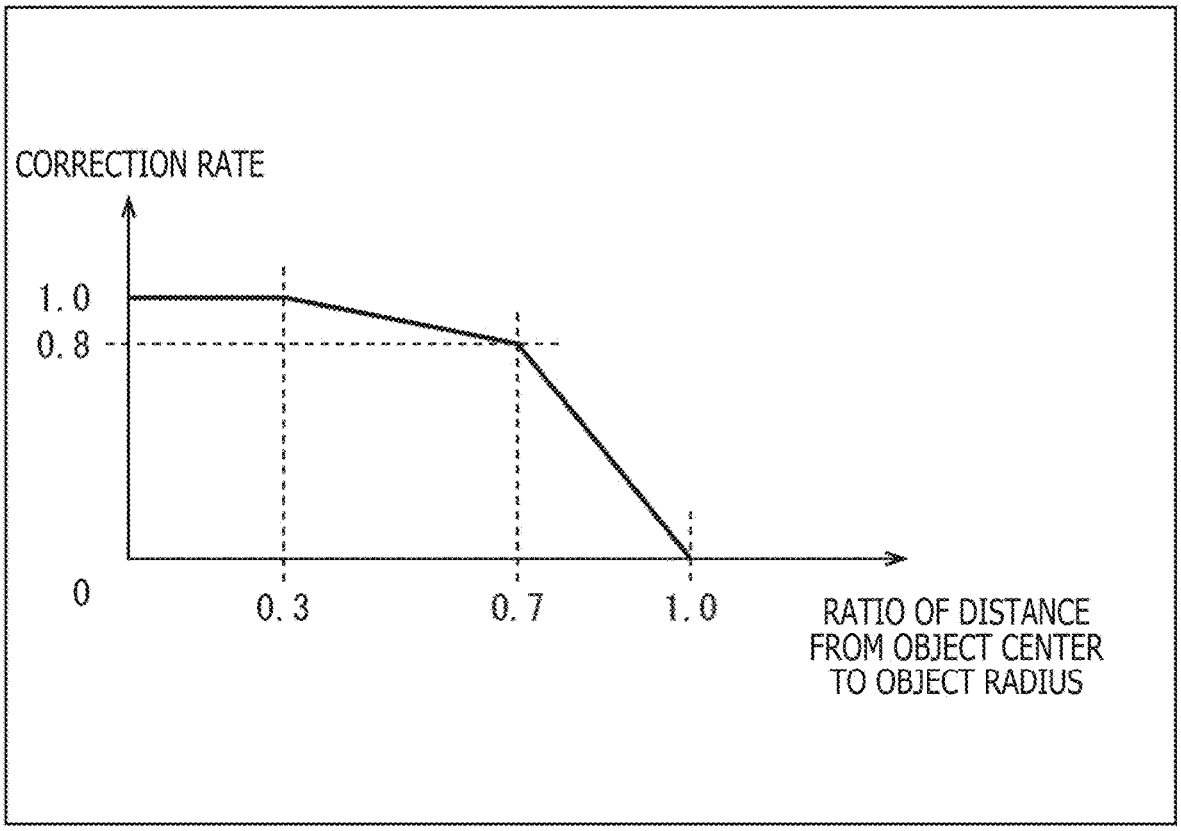
FIG. 9 is a diagram describing a correction table.

Also, for example, a correction table indicated by a certain correction table index is information indicating the relationship between a radius ratio and a correction rate illustrated in FIG. 9.

In FIG. 9, the vertical axis represents the correction rate of the attenuation level, and the horizontal axis represents the radius ratio. In the example illustrated in FIG. 6, for example, the ratio of the magnitude of the normal vector N2_1 to the radius OR2 is the radius ratio.

For example, in the case where the radius ratio is 0, a sound traveling from the attenuation process object toward the origin O, i.e., to the user, passes through the center of the object subject to attenuation, and in the case where the radius ratio is 1, a sound traveling from the attenuation process object toward the origin O passes through a border part of the object subject to attenuation.

In such an example, the larger the radius ratio, the smaller the correction rate, and the larger the radius ratio, the greater the change in the correction rate relative to the variation in the radius ratio. For example, in the case where the correction rate is 1.0, the attenuation level obtained from the attenuation table is used as it is, and in the case where the correction rate is 0, the attenuation level obtained from the attenuation table is set to 0. As a result, the attenuation effect is 0. It should be noted that, in the case where the radius ratio is greater than 1, a sound traveling from the attenuation process object toward the origin O does not pass through any region of the object subject to attenuation. Therefore, the attenuation process is not performed.

When an attenuation level and a correction rate appropriate to an attenuation distance and a radius ratio are obtained on the basis of the attenuation distance and the radius ratio, a correction value is obtained on the basis of the attenuation distance and the radius ratio, thus correcting the object gain information.

Specifically, the value obtained by multiplying the attenuation level by the correction rate, i.e., the product of the correction rate and the attenuation level, is used as a correction value. The correction value is a final attenuation level obtained by correcting the attenuation level with the correction rate. When the correction value is obtained, the correction value is added to the object gain information, thus correcting the object gain information. Then, the corrected object gain information obtained in such a manner, i.e., the sum of the correction value and the object gain information, is used as the corrected object gain information.

The correction value, which is the product of the correction rate and the attenuation level, can be said to indicate the attenuation level of an object signal that is used for realizing the level adjustment corresponding to the attenuation undergone by a sound of a certain object in another object and that is determined on the basis of the positional relationship between the objects.

It should be noted that an example has been described here in which an attenuation table index and a correction table index that are made available in advance are included in metadata as the object attenuation information. However, as long as an attenuation level and a correction rate can be obtained, for example, by using change points in a line corresponding to the attenuation table and the correction table illustrated in FIGS. 8 and 9 as the object attenuation information, any kind of object attenuation information can be used.

In addition to the above, for example, a plurality of attenuation functions, that is, continuous functions having attenuation distances as inputs and giving attenuation levels as outputs, and a plurality of correction rate functions, that is, continuous functions having radius ratios as inputs and giving correction rates as outputs, may be made available such that an index indicating any of the plurality of attenuation functions and an index indicating any of the plurality of correction rate functions are used as the object attenuation information. Further, a plurality of continuous functions having attenuation levels and radius ratios as inputs and giving correction values as outputs may be made available in advance such that an index indicating any of the functions is used as the object attenuation information.

<Description of the Audio Output Process>

Figure 10:
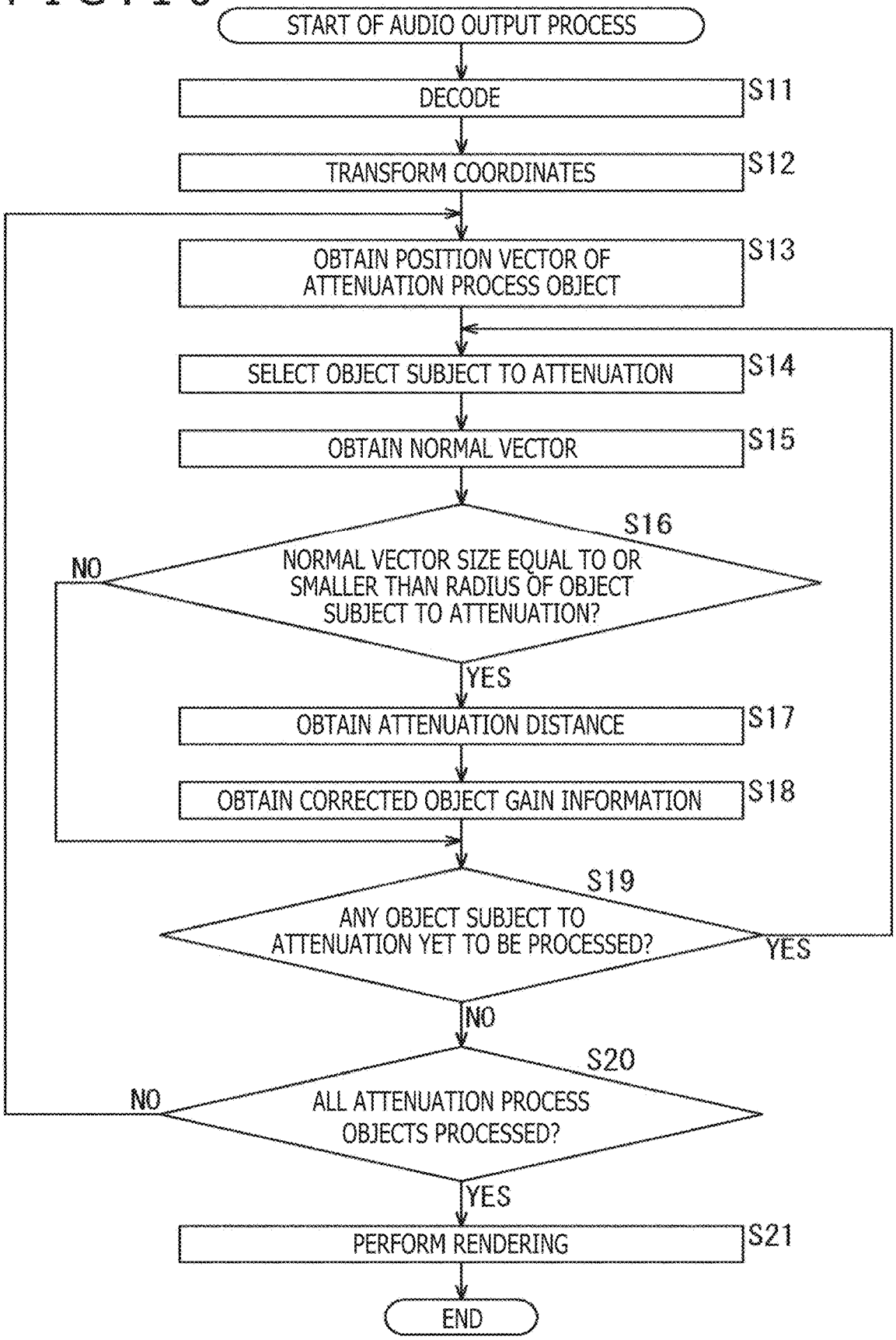
FIG. 10 is a flowchart describing an audio output process.

A description will be given next of specific operation of the signal processing apparatus 11. That is, an audio output process performed by the signal processing apparatus 11 will be described below with reference to the flowchart illustrated in FIG. 10.

In step S11, the decoding process section 21 decodes a received input bit stream, thus acquiring metadata and an object signal.

The decoding process section 21 supplies the object position information of the acquired metadata to the coordinate transformation process section 22 and supplies the object outer diameter information, the object attenuation information, the object attenuation disabling information, and the object gain information of the acquired metadata to the object attenuation process section 23. Also, the decoding process section 21 supplies the acquired object signal to the rendering process section 24.

In step S12, the coordinate transformation process section 22 transforms coordinates of each object on the basis of the object position information supplied from the decoding process section 21 and the user position information supplied from external equipment, thus generating the object spherical coordinate position information and supplying the generated information to the object attenuation process section 23.

In step S13, the object attenuation process section 23 not only selects a target attenuation process object, on the basis of the object attenuation disabling information supplied from the decoding process section 21 and the object spherical coordinate position information supplied from the coordinate transformation process section 22, but also obtains a position vector of the attenuation process object.

For example, the object attenuation process section 23 selects an object whose value of the object attenuation disabling information is 0 for use as the attenuation process object. Then, the object attenuation process section 23 calculates, as a position vector, a vector having the origin O, i.e., the user position, as its start point and the position of the attenuation process object as its end point on the basis of the object spherical coordinate position information of the attenuation process object.

For example, therefore, in the case where the object OBJ1 is selected as the attenuation process object in the example illustrated in FIG. 6, the vector OP1 is obtained as the position vector.

In step S14, the object attenuation process section 23 selects, as an object subject to attenuation with respect to the target attenuation process object, an object whose distance from the origin O is smaller (shorter) than the target attenuation process object on the basis of the object spherical coordinate position information of the target attenuation process object and that of the other object.

For example, in the case where the object OBJ1 is selected as the attenuation process object in the example illustrated in FIG. 6, the object OBJ2 located closer to the origin O than the object OBJ1 is selected as the object subject to attenuation.

In step S15, the object attenuation process section 23 obtains a normal vector from the center of the object subject to attenuation with respect to the position vector of the attenuation process object on the basis of the position vector of the attenuation process object acquired in step S13 and the object spherical coordinate position information of the object subject to attenuation.

For example, in the case where the object OBJ1 is selected as the attenuation process object and the object OBJ2 is selected as the object subject to attenuation in the example illustrated in FIG. 6, the normal vector N2_1 is obtained.

In step S16, the object attenuation process section 23 determines whether or not the magnitude of the normal vector is equal to or smaller than the radius of the object subject to attenuation on the basis of the normal vector obtained in step S15 and the object outer diameter information of the object subject to attenuation.

For example, in the case where the object OBJ1 is selected as the attenuation process object and the object OBJ2 is selected as the object subject to attenuation in the example illustrated in FIG. 6, it is determined whether or not the magnitude of the normal vector N2_1 is equal to or smaller than the radius OR2 that is half the outer diameter of the object OBJ2.

In the case where it is determined, in step S16, that the magnitude of the normal vector is not equal to or smaller than the radius of the object subject to attenuation, the object subject to attenuation is not in the path of a sound that is emitted from the attenuation process object and travels toward the origin O (the user). Therefore, the processes in steps S17 and S18 are not performed, and the process proceeds to step S19.

In contrast, in the case where it is determined, in step S16, that the magnitude of the normal vector is equal to or smaller than the radius of the object subject to attenuation, the object subject to attenuation is in the path of a sound that is emitted from the attenuation process object and travels toward the origin O (the user). Therefore, the process proceeds to step S17. In such a case, the attenuation process object and the object subject to attenuation are located approximately in the same direction as seen from the user.

In step S17, the object attenuation process section 23 obtains an attenuation distance on the basis of the position vector of the attenuation process object acquired in step S13 and the normal vector of the object subject to attenuation acquired in step S15. Also, the object attenuation process section 23 obtains a radius ratio on the basis of the object outer diameter information and the normal vector of the object subject to attenuation.

For example, in the case where the object OBJ1 is selected as the attenuation process object and the object OBJ2 is selected as the object subject to attenuation in the example illustrated in FIG. 6, the distance from the position P2_1 to the position O11, i.e., |OP1|-|OP2_1|, is obtained as the attenuation distance. Further, in such a case, the ratio of the magnitude of the normal vector N2_1 to the radius OR2, i.e., |N2_1|/OR2, is obtained as the radius ratio.

In step S18, the object attenuation process section 23 obtains the corrected object gain information of the attenuation process object on the basis of the object gain information of the attenuation process object, the object attenuation information of the object subject to attenuation, and the attenuation distance and the radius ratio acquired in step S17.

For example, in the case where the attenuation table index and the correction table index described above are included in metadata as the object attenuation information, the object attenuation process section 23 holds, in advance, a plurality of attenuation tables and a plurality of correction tables.

In such a case, the object attenuation process section 23 reads out an attenuation level determined with respect to the attenuation distance from the attenuation table indicated by the attenuation table index as the object attenuation information of the object subject to attenuation.

Also, the object attenuation process section 23 reads out a correction rate determined with respect to the radius ratio from the correction table indicated by the correction table index as the object attenuation information of the object subject to attenuation.

Then, the object attenuation process section 23 obtains a correction value by multiplying the attenuation level that has been read out by the correction rate and then obtains the corrected object gain information by adding the correction value to the object gain information of the attenuation process object.

The process of obtaining the corrected object gain information in such a manner can be said to be a process of determining the correction value that indicates the attenuation level of the object signal on the basis of the attenuation distance and the radius ratio, i.e., the positional relationship between the objects, and further determining the corrected object gain information, that is, a gain for adjusting the object signal level on the basis of the correction value.

When the corrected object gain information is obtained, the process proceeds thereafter to step S19.

When the process in step S18 is performed or when it is determined, in step S16, that the magnitude of the normal vector is not equal to or smaller than the radius, the object attenuation process section 23 determines, in step S19, whether or not there is any object subject to attenuation that has yet to be processed for the target attenuation process object.

In the case where it is determined, in step S19, that there is still an object subject to attenuation that has yet to be processed, the process returns to step S14, and the above processes are repeated.

In such a case, in the process of step S18, a correction value obtained for a new object subject to attenuation is added to the corrected object gain information that has already been obtained, thus updating the corrected object gain information. Therefore, in the case where there is a plurality of objects subject to attenuation the magnitudes of whose normal vectors are equal to or smaller than the radius with respect to the attenuation process object, the sum of the object gain information and the correction values obtained respectively for the plurality of objects subject to attenuation is acquired as final corrected object gain information.

Also, in the case where it is determined, in step S19, that there is no more object subject to attenuation that has yet to be processed, that is, that all the objects subject to attenuation have been processed, the process proceeds to step S20.

In step S20, the object attenuation process section 23 determines whether or not all the attenuation process objects have been processed.

In the case where it is determined, in step S20, that all the attenuation process objects have yet to be processed, the process returns to step S13, and the above processes are repeated.

In contrast, in the case where it is determined, in step S20, that all the attenuation process objects have been processed, the process proceeds to step S21.

In such a case, the object attenuation process section 23 uses the object gain information of those objects that have not undergone the process in step S17 or S18, i.e., the attenuation process, as it is, as the corrected object gain information.

Also, the object attenuation process section 23 supplies the object spherical coordinate position information and the corrected object gain information of all the objects supplied from the coordinate transformation process section 22 to the rendering process section 24.

In step S21, the rendering process section 24 performs a rendering process on the basis of the object signal supplied from the decoding process section 21 and the object spherical coordinate position information and the corrected object gain information supplied from the object attenuation process section 23, thus generating an output audio signal.

When the output audio signal is acquired in such a manner, the rendering process section 24 outputs the acquired output audio signal to the subsequent stage, thus terminating the audio output process.

The signal processing apparatus 11 corrects the object gain information as described above according to the positional relationship between the objects, thus obtaining the corrected object gain information. This makes it possible to create a great sense of realism with a small number of computations.

That is, in the case where there is a plurality of objects approximately in the same direction as seen from the user in the listening space, attenuation effects that occur as a result of absorption, diffraction, reflection, and so on of a sound of the object are not calculated on the basis of physics laws. Instead, a correction value appropriate to the attenuation distance and the radius ratio is obtained by using tables. Such a simple calculation provides substantially same effects as in the case of calculation on the basis of physics laws. Therefore, even in the case where the user moves freely in the listening space, it is possible to deliver three-dimensional acoustic effects with a great sense of realism to the user with a small number of computations.

It should be noted that, although a case of a free viewpoint where the user can move to any position in the listening space has been described here, it is also possible to create a great sense of realism with a small number of computations in the case of a fixed viewpoint where the user position is fixed in the listening space as in the case of the free viewpoint.

In such a case, the user position indicated by the user position information is always the position of the origin O. This eliminates the need for the coordinate transformation process by the coordinate transformation process section 22, and the object position information is position information represented by spherical coordinates. In such a case in particular, the object position information is information representing the object position as seen from the origin O. Also, the process performed by the object attenuation process section 23 may be performed on the side of a client that receives delivery of content or on the side of a server that delivers content.

<Modification Example>

In addition, although a case has been described above where the object attenuation disabling information is 0 or 1, the object attenuation disabling information may be set to any of a plurality of three or more values. In such a case, for example, the value of the object attenuation disabling information indicates not only whether or not an object is an attenuation-disabled object but also a correction level for the attenuation level. Therefore, the correction value obtained from the correction rate and the attenuation level is further corrected according to the value of the object attenuation disabling information for use as a final correction value, for example.

Further, although a case has been described above where the object attenuation disabling information that indicates whether or not to disable the attenuation process is determined for each object, it may be determined for the region inside the listening space whether or not to disable the attenuation process.

For example, if the intention of the sound source creator is that attenuation effects caused by an object in a specific spatial region inside the listening space are not desired, for example, it is only necessary to store, in an input bit stream, the object attenuation disabling region information indicating a spatial region free from attenuation effects in place of the object attenuation disabling information.

In such a case, the object attenuation process section 23 treats an object as an attenuation-disabled object if the position indicated by the object position information falls within the spatial region indicated by the object attenuation disabling region information. This makes it possible to realize audio reproduction that reflects the intention of the sound source creator.

Also, the positional relationship between the user and the objects may also be considered, for example, by treating an object located approximately in a front direction as seen from the user as an attenuation-disabled object and an object behind the user as an attenuation process object. That is, whether or not to treat an object as the attenuation-disabled object may be determined on the basis of the positional relationship between the user and the objects.

In addition to the above, although an example has been described above in which an object signal is attenuated according to the relative positional relationship between objects, reverberation effects may be applied to the object signal according to the relative positional relationship between objects, for example.

It has been long known that reverberation effects are produced by trees in woods, and Kuttruff models the reverberation of woods by regarding trees as spheres and solving a diffusion equation.

For such a reason, for example, in the case where there are as many as or more objects than a predetermined number in a given space including the user position and the position of an object that produces a sound, a possible option would be to apply specific reverberation effects to the object signal of each object in the space.

In such a case, reverberation effects can be applied by including a parametric reverb coefficient for applying reverberation effects in an input bit stream and varying a mixture ratio between a direct sound and a reverberated sound according to the relative positional relationship between the user position and the position of the object that produces a sound.

<Configuration Example of the Computer>

Incidentally, the above series of processes can be performed by hardware or software. In the case where the series of processes are performed by software, a program included in the software is installed to a computer. Here, the computer includes a computer incorporated in dedicated hardware, a general-purpose personal computer capable of performing various functions as various programs are installed, and so on.

Figure 11:
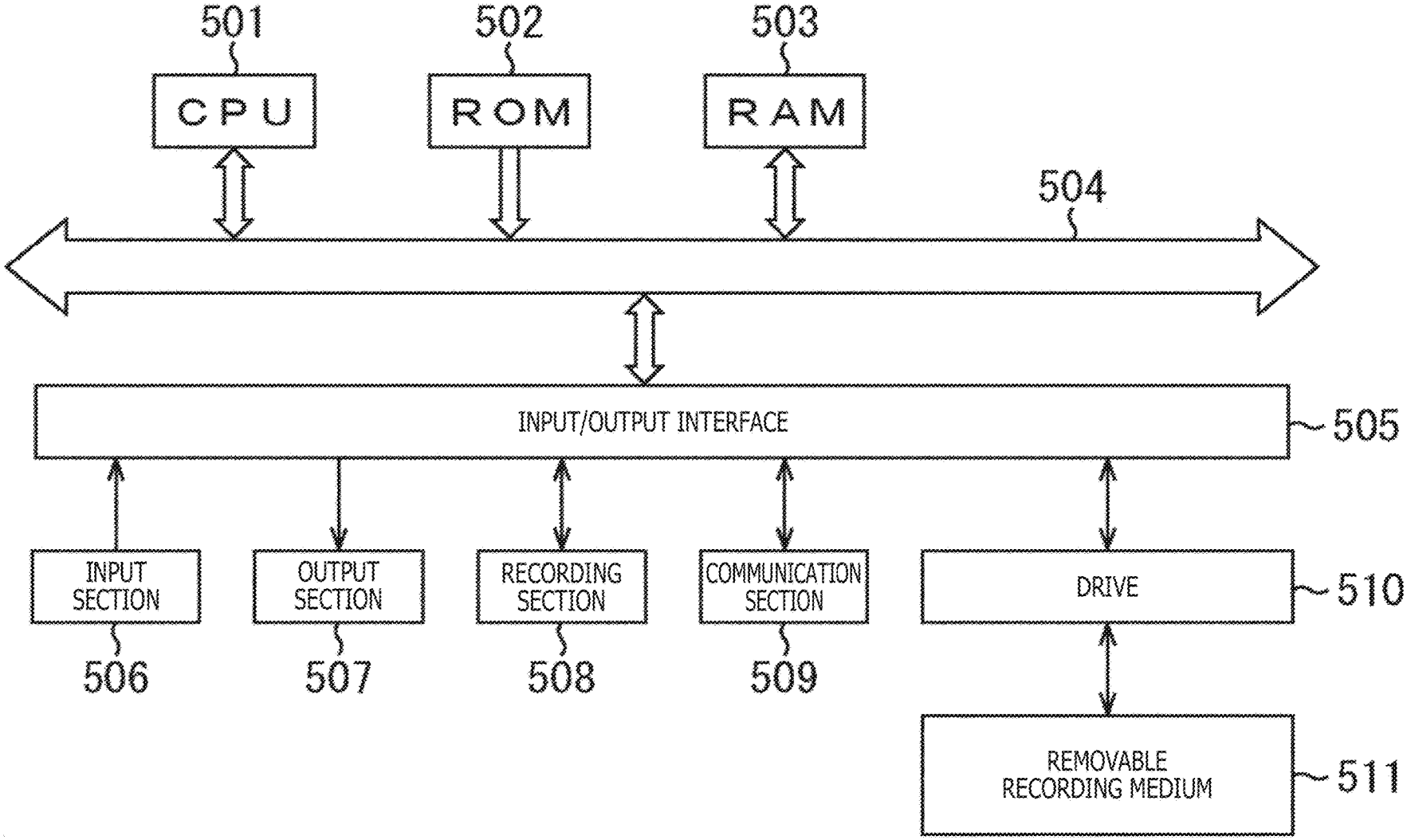
FIG. 11 is a diagram illustrating a configuration example of a computer.

FIG. 11 is a block diagram illustrating a hardware configuration example of a computer that performs the above series of processes by executing a program.

In the computer, a CPU (Central Processing Unit) 501, a ROM (Read Only Memory) 502, and a RAM (Random Access Memory) 503 are connected to each other by a bus 504.

An input/output interface 505 is further connected to the bus 504. An input section 506, an output section 507, a recording section 508, a communication section 509, and a drive 510 are connected to the input/output interface 505.

The input section 506 includes a keyboard, a mouse, a microphone, an imaging element, and so on. The output section 507 includes a display, a speaker, and so on. The recording section 508 includes a hard disk, a non-volatile memory, and so on. The communication section 509 includes a network interface and so on. The drive 510 drives a removable recording medium 511 such as a magnetic disk, an optical disc, a magneto-optical disk, or a semiconductor memory.

In the computer configured as described above, the CPU 501 loads, for example, the program recorded in the recording section 508 via the input/output interface 505 and the bus 504 into the RAM 503 for execution, thus allowing the above series of processes to be performed.

The program executed by the computer (CPU 501) can be provided in a manner recorded in the removable recording medium 511 as package media. Also, the program can be provided via a wired or wireless transmission medium such as a local area network, the internet, and digital satellite broadcasting.

In the computer, the program can be installed to the recording section 508 via the input/output interface 505 by inserting the removable recording medium 511 into the drive 510. Also, the program can be received by the communication section 509 via a wired or wireless transmission medium and installed to the recording section 508. In addition to the above, the program can be installed in advance to the ROM 502 or the recording section 508.

It should be noted that the program executed by the computer may perform the processes not only chronologically according to the sequence described in the present specification but also in parallel or at a necessary timing as when invoked.

Also, embodiments of the present technology are not limited to those described above and can be modified in various ways without departing from the gist of the present technology.

For example, the present technology can have a cloud computing configuration in which a single function is processed among a plurality of apparatuses in a shared and cooperative manner through a network.

Also, each step described in the above flowchart can be carried out not only by a single apparatus but also by a plurality of apparatuses in a shared manner.

Further, in the case where one step includes a plurality of processes, the plurality of processes included in the step is performed not only by a single apparatus but also by a plurality of apparatuses in a shared manner.

Further, the present technology can have the following configurations.

(1)

An information processing apparatus including:

a gain determination section adapted to determine an attenuation level on the basis of a positional relationship between a given object and another object and determine a gain of a signal of the given object on the basis of the attenuation level.

(2)

The information processing apparatus of feature (1), in which the other object is located closer to a side of a user position than the given object.

(3)

The information processing apparatus of feature (1) or (2), in which the other object is located within a range of a given distance from a straight line connecting the user position and the given object.

(4)

The information processing apparatus of feature (3), in which the range is determined by a size of the other object.

(5)

The information processing apparatus of feature (3) or (4), in which the given distance includes a distance from a center of the other object to an end of the other object on a side of the straight line.

(6)

The information processing apparatus of any one of features (3) to (5), in which the positional relationship depends upon a size of the other object.

(7)

The information processing apparatus of feature (6), in which the positional relationship includes an amount of deviation of a center of the other object from the straight line.

(8)

The information processing apparatus of feature (6), in which the positional relationship includes a ratio of a distance from a center of the other object to the straight line to a distance from the center of the other object to an end of the other object on a side of the straight line.

(9)

The information processing apparatus of any one of features (1) to (8), in which the gain determination section determines the attenuation level on the basis of the positional relationship and attenuation information of the other object.

(10)

The information processing apparatus of feature (9), in which the attenuation information includes information for acquiring the attenuation level of the signal appropriate to the positional relationship in the other object.

(11)

The information processing apparatus of any one of features (1) to (10), in which the positional relationship includes a distance between the other object and the given object.

(12)

The information processing apparatus of any one of features (1) to (11), in which the gain determination section determines the attenuation level on the basis of attenuation disabling information indicating whether or not to attenuate the signal of the given object and the positional relationship.

(13)

The information processing apparatus of any one of features (1) to (11), in which the signal of the given object includes an audio signal.

(14)

An information processing method performed by an information processing apparatus, comprising:

determining an attenuation level on the basis of a positional relationship between a given object and another object and determining a gain of a signal of the given object on the basis of the attenuation level.

(15)

A program causing a computer to perform a process including the step of:

determining an attenuation level on the basis of a positional relationship between a given object and another object and determining a gain of a signal of the given object on the basis of the attenuation level.

REFERENCE SIGNS LIST

11 Signal processing apparatus, 21 Decoding process section, 22 Coordinate transformation process section, 23 Object attenuation process section, 24 Rendering process section

The invention claimed is:

1. An information processing apparatus comprising:

a gain determination section adapted to determine an attenuation level on a basis of a positional relationship between a given object and an additional object and determine a gain of a signal of the given object on a basis of the attenuation level, wherein:

the positional relationship includes a radius ratio of a first distance to a second distance, the first distance is from the additional object to a straight line, the second distance is from the additional object to an end of the additional object on a side of the straight line, and the straight line is connecting a user position and the given object.

2. The information processing apparatus of claim 1, wherein the additional object is located closer to a side of a user position than the given object.

3. The information processing apparatus of claim 1, wherein the additional object is located within a range of a given distance from the straight line connecting a user position and the given object.

4. The information processing apparatus of claim 3, wherein the range is determined by a size of the additional object.

5. The information processing apparatus of claim 3, wherein the given distance includes a distance from a center of the additional object to the end of the additional object on the side of the straight line.

6. The information processing apparatus of claim 3, wherein the positional relationship depends upon a size of the additional object.

7. The information processing apparatus of claim 6, wherein the positional relationship includes an amount of deviation of a center of the additional object from the straight line.

8. The information processing apparatus of claim 1, wherein the first distance is from a center of the additional object to the straight line, and the second distance is from the center of the additional object to end of the other additional object on the side of the straight line.

9. The information processing apparatus of claim 1, wherein the gain determination section determines the attenuation level on a basis of the positional relationship and attenuation information of the additional object.

10. The information processing apparatus of claim 9, wherein the attenuation information includes information for acquiring the attenuation level of the signal appropriate to the positional relationship in the additional object.

11. The information processing apparatus of claim 1, wherein the positional relationship includes a distance between the additional object and the given object.

12. The information processing apparatus of claim 1, wherein the gain determination section determines the attenuation level on a basis of attenuation disabling information indicating whether or not to attenuate the signal of the given object and the positional relationship.

13. The information processing apparatus of claim 1, wherein the signal of the given object includes an audio signal.

14. An information processing method performed by an information processing apparatus, comprising:

determining an attenuation level on a basis of a positional relationship between a given object and an additional object and determining a gain of a signal of the given object on a basis of the attenuation level, wherein:

the positional relationship includes a radius ratio of a first distance to a second distance, the first distance is from the additional object to a straight line, the second distance is from the additional object to an end of the additional object on a side of the straight line, and the straight line is connecting a user position and the given object.

15. A non-transitory computer-readable storage medium storing processor-executable instructions that, when executed by at least one processor, cause the at least one processor to carry out a method, the method comprising:

determining an attenuation level on a basis of a positional relationship between a given object and an additional object and determining a gain of a signal of the given object on a basis of the attenuation level, wherein:

the positional relationship includes a radius ratio of a first distance to a second distance, the first distance is from the additional object to a straight line, the second distance is from the additional object to an end of the additional object on a side of the straight line, and the straight line is connecting a user position and the given object.

* * * * *